United States Patent [19]

Brutti

[11] 4,375,787

[45] Mar. 8, 1983

[54] MACHINE FOR STITCHING THE UPPER BORDER OF SHOES COMMONLY CALLED MOCCASINS

[75] Inventor: Mario Brutti, Monte Urano, Italy

[73] Assignee: Costruzioni Macchine da Cucire Industriali la Mocassino di Berdini Ezio & C.S. n.c., Fermo, Italy

[21] Appl. No.: 231,372

[22] Filed: Feb. 4, 1981

[30] Foreign Application Priority Data

Feb. 22, 1980 [IT] Italy ..... 3340 A/80

[51] Int. Cl.[3] ..... D05B 15/00

[52] U.S. Cl. ..... 112/28

[58] Field of Search ..... 12/11, 142 MO; 112/28, 112/53, 54, 35, 37

[56] References Cited

U.S. PATENT DOCUMENTS 3,460,494 8/1969 Denlser ..... 112/28

FOREIGN PATENT DOCUMENTS 283175 9/1913 Fed. Rep. of Germany ..... 112/28

1367822 6/1964 France ..... 112/28

*Primary Examiner*—Patrick D. Lawson

[57] ABSTRACT

The machine in question is for stitching the upper border of the tubular type of moccasin where the shoe upper is folded back externally over the vamp and is stitched with both initially extending in one plane, and it comprises a needle-first presser foot ensemble, movable perpendicularly to the parts to be stitched and parallel therewith, the infeed motion corresponding to the length of one stitch, a second presser foot placed downstream of the previously mentioned ensemble with respect to the infeed motion, movable perpendicularly to the parts to be stitched, for the locking thereof, a ruffler presser foot, positioned upstream of the said ensemble, movable perpendicularly to the parts to be stitched and parallel therewith, designed to ruffle the vamp jointly with a separator member fixed to the frame; the machine also comprises a device for folding the shoe upper back over the ramp, constituted by a disk on a horizontal shaft, perpendicular to the said parts to be stitched, and placed above the said ruffler presser foot, acting in unison therewith.

20 Claims, 16 Drawing Figures

15
12"
12
35
36
44
37
37'
11
11'
11"
59
60
54
53
12'
13
14
43
42
40
41
34
33
32
52
51
50
49
32
31
38
29
48
30
30'
3
72
58
57"
57
57'
24
119
28
61
46
56
27
39
26
47
55
25
24
23
147
22
20
3
21

170
98
84
85
173
83
74
73
86
76
75
77
81
71
82
70
67
68
78
69
79
57
11'
11"
80
65
63
87
62
66
10
64
12
60
24
28
13
171

FIG 6
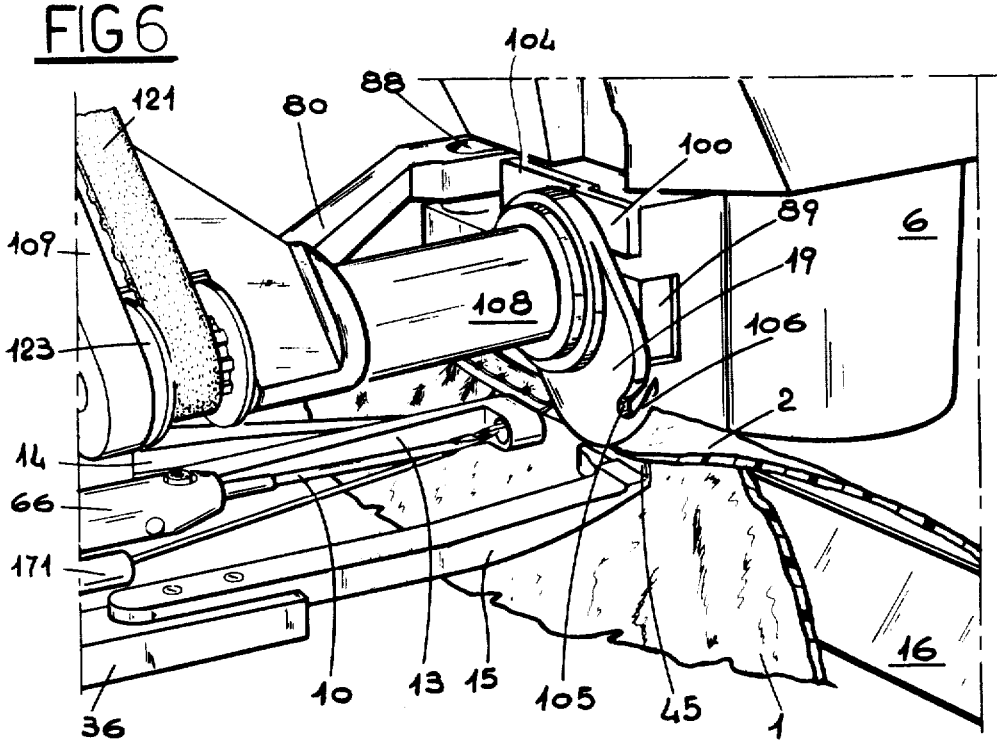
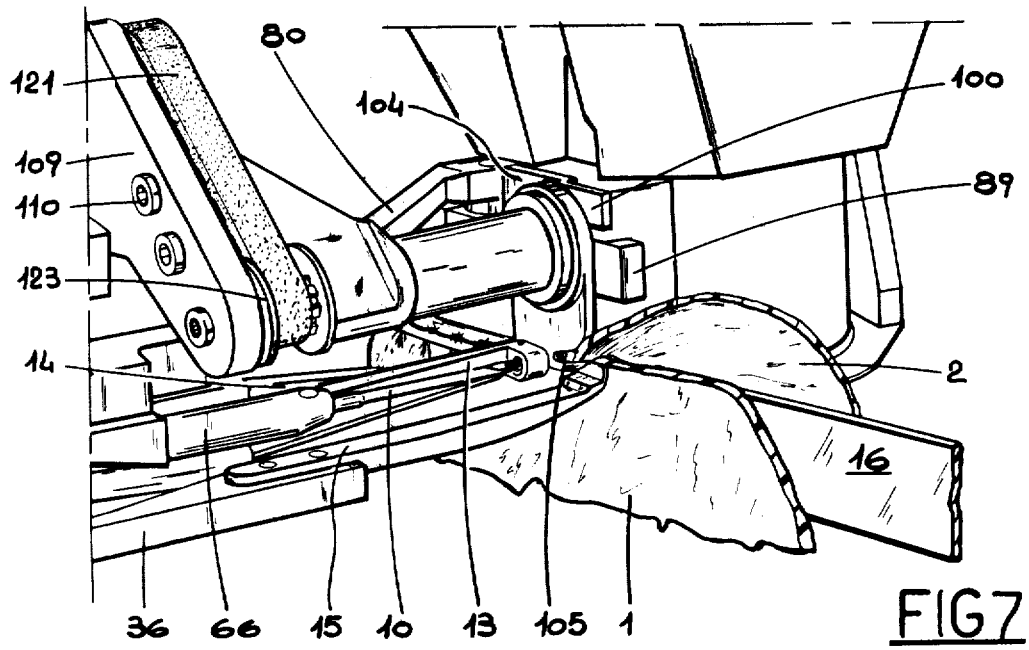
FIG 7

MACHINE FOR STITCHING THE UPPER BORDER OF SHOES COMMONLY CALLED MOCCASINS

BACKGROUND OF THE INVENTION

The invention relates to a machine for stitching the upper border of shoes commonly called moccasins, that is to say, a non lace-up shoe, generally made of soft leather, formed by a lower part, or vamp, open at the end or closed as in the case of the machine in question for tubular moccasins, joined to an upper part which constitutes the sealing element of the shoe.

DESCRIPTION OF THE PRIOR ART

Up until now, the stitching between the shoe upper and the vamp has, in the traditional moccasin where the shoe upper is superposed externally over the vamp, as can be seen in FIG. 14, been achieved solely by hand, though in practice machines do exist for the automatic stitching between the shoe upper and the vamp, but with the former superposed simply over the latter without being folded back thereon.

Furthermore, in order to perform the said stitching and since the extension on the flat of the edge of the vamp is notably greater than the extension on the flat of the edge of the shoe upper, it is necessary, at the time of stitching, to ruffle the edge of the vamp by the amount needed to reduce it to the same length as the edge of the shoe upper. To do this, known automatic machines generally utilize a pair of ruffler feet or jaws that are able to nip and infeed the vamp with a sliding motion with respect to the underneath shoe upper.

Since the amount of vamp to be ruffled varies during the stitching operation, that is to say, it has to be the bare minimum in the region of the stitching extremities (namely laterally to the shoe) and then progressively increase in the region of the toe of the shoe until the maximum value has been reached, a manual control exists on the aforementioned machines through which the amount of ruffle is controlled by hand by the operative. All this person has to do is to manipulate the control device in such a way as to cause the scores made on the vamp and on the shoe upper at the time they are being cut, to match throughout the stitching procedure.

One obvious problem that arises during the said operation lies in the fact that it is very difficult for the operative to calculate and achieve a constant increase (in the semi-phase of the stitching from the lateral edge to the toe) prior to the ruffling of the vamp, and subsequently, a constant decrease during the final semi phase, often being compelled to increase considerably (or to decrease) the amount of ruffle in order to keep in line with the scores.

SUMMARY OF THE INVENTION

The essential object of the invention is, therefore, to make available a machine with which the automatic stitching of the upper border of shoes of the moccasin, and even of the tubular moccasin type, is possible; the stitching being of the traditional type with the shoe upper folded back externally over the vamp so as to form, therefore, the conventional protruding "ridge" of stitching on any type of more or less soft hide.

A further object of the invention is to make available a machine with which the said stitching border can be achieved and the amount by which the vamp has to be ruffled is adjusted automatically throughout the entire stitching operation both on shoes for the right foot and on those for the left foot.

These and other objects too are all attained with the machine according to the invention, comprising a base body that extends vertically, is essentially in the form of an upside-down "U", and is provided at the front with an overhanging head containing the vertical shaft mounted "crochet", the said machine being provided with a needle, movable horizontally, with reciprocating motion, in the two directions towards and away from the aforementioned "crochet", and being given, in time with the latter, transverse translatory motion in a horizontal plane, perpendicular to its own axis, for infeeding the material, the said machine being equipped, furthermore, with a dog supported by the said overhanging head to the front of the "crochet", movable horizontally along a vertical plane, virtually perpendicular to the needle and in harmony with the horizontal transverse translatory motion thereof, the said dog constituting a movable working surface for the abutment of the edges of the vamp and of the shoe upper to be stitched and comprising, furthermore, a first presser foot, cantilever supported horizontally by the said body in the immediate vicinity of the said needle, and also movable similarly to the latter, horizontally and transversely, to operate in contrast with the said dog and to lock the material-shoe upper-vamp ensemble and to displace it in time with the horizontal transverse movement of the needle, the said machine also comprising a second presser foot, cantilever supported horizontally by the said body to the rear of the said first presser foot with respect to the transverse infeed direction of the materials, movable horizontally in the two directions and in contrast with the said overhanging head in order to lock the material already stitched and carried along by the needle-first presser foot-dog ensemble, the said machine being characterized in that it comprises: a virtually flat separator member that extends in a vertical plane parallel to that of the dog, positioned upstream of the needle and designed to separate the vamp from the shoe upper being infed to the needle; a third ruffler presser foot, cantilever supported horizontally by the said body, placed upstream of the first presser foot and movable horizontally in the two directions towards and away from the said separator member, in contrast therewith, subjected to means for transverse translation in the two directions, along a path parallel to the said dog but in the direction opposite to that of translation of the latter, the said third presser foot being provided to lock and ruffle the vamp jointly with the said separator member; and a fold-back device cantilever supported by the said body, located above the said third presser foot, provided to fold, at the point where the said third presser foot is lowered to lock the vamp on the separator, the border of the shoe upper back onto the vamp.

BRIEF DESCRIPTION OF THE DRAWINGS

Further characteristics of the invention in question will emerge more obviously from the detailed description that follows of one preferred form of embodiment, illustrated purely as an unlimited example on the accompanying drawings, in which:

FIGS. 6, 7, 8, 9 and 10 show, diagrammatically, in five front perspective views, the succession of stitching operations between the vamp and the shoe upper;

DESCRIPTION OF THE PREFERRED EMBODIMENT

Figure 15:
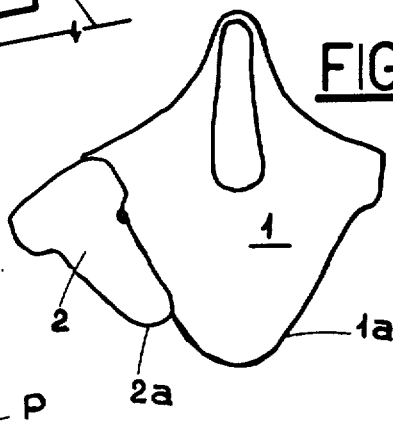
FIG. 15 shows the two parts (vamp and shoe upper) used to make the shoe.
Figure 14A:
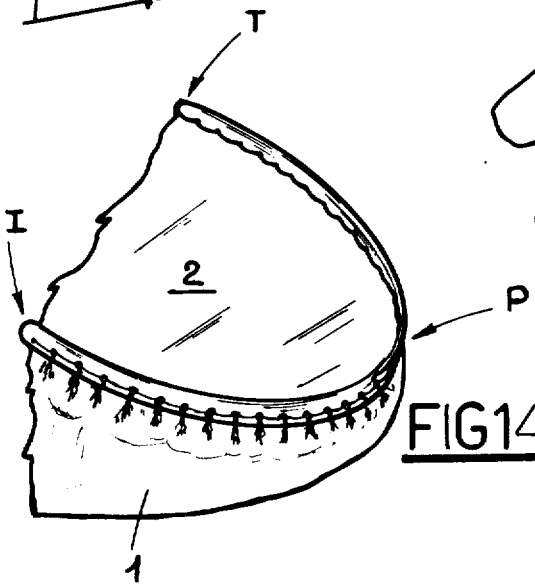
FIGS. 14 and 14*a* show, diagrammatically, the type of shoe with stitched border that can be handled by the machine in question.
Figure 14:
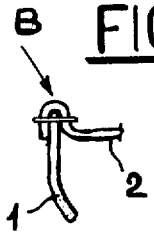

In FIGS. 14*a* and 15 is illustrated a shoe of tubular moccasin type, that is to say, a shoe formed by the mutual union, through stitching, of a vamp 1 and a shoe upper 2, in the region of the two borders 1*a* and 2*a*, the first of which is of a lengthwise extension notably greater than the latter mentioned one and thus, at the time of stitching, it is necessary to ruffle the border of the vamp in a way that is not constant but increases progressively from the commencement I of the stitching up to the region of the toe of the shoe P, and then decreases anew up to the end of the stitching T. The foregoing relates to the typical conformation of the shoe and to the relevant parts thereof.

Again in FIG. 14*b* the particular conformation of the stitching, that one can call of the conventional type, namely with the shoe upper 2 folded back externally onto the vamp up to the formation of a projecting border B, can be seen.

Figure 1:
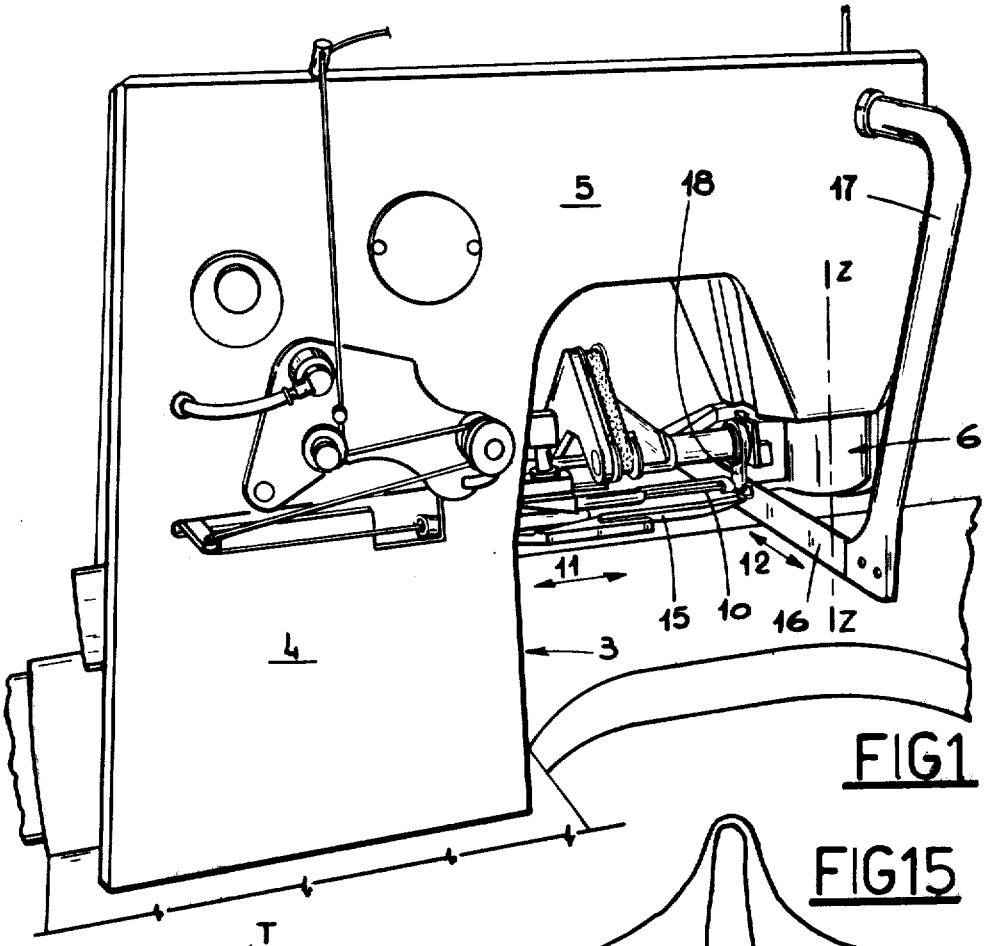
FIG. 1 shows, diagrammatically, a front perspective view of the machine in question.

In FIG. 1, instead, is illustrated the machine in question, composed of a vertically extending base body 3, virtually in the form of an upside-down "U", one limb 4 of which serves as a support for an overhanging head 5 that sustains and houses the mechanism for the movement of the "crochet" shown globally at 6 which reciprocates around a vertical shaft (axis z—z).

Figure 11:
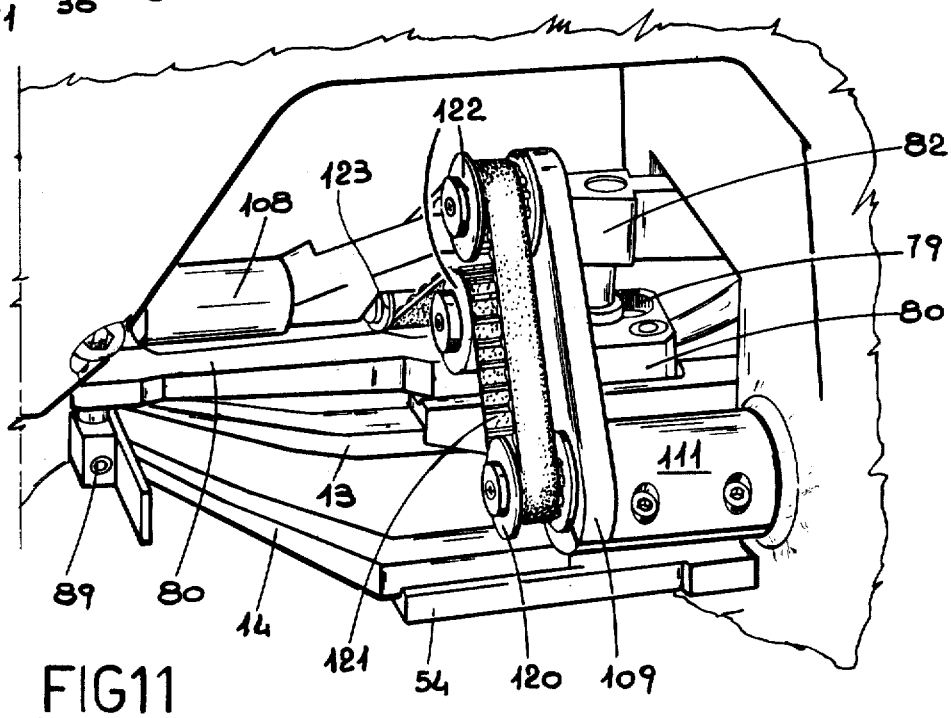
FIG. 11 shows, diagrammatically and seen from the rear, a perspective view of the operating mechanism of the machine.
Figure 12:
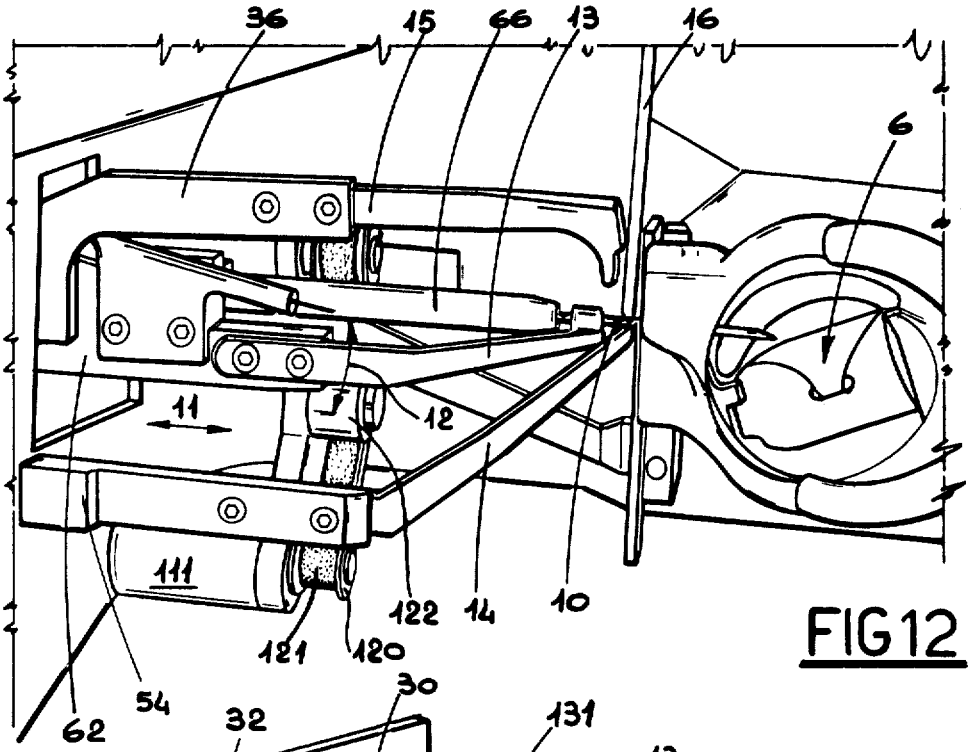
FIG. 12 shows, diagrammatically and seen from below, a perspective view of the operating mechanism of the machine.

From the limb 4 projects all the operating mechanism of the machine constituted (later on the control mechanism thereof and the function of this will be seen in detail), see also FIGS. 6, 11 and 12, by a needle 10 movable horizontally, reciprocating in the two directions shown at 11 towards and away from the aforementioned "crochet" 6 of the type commonly known that rotates backwards and forwards in unison with the entry of the needle for the formation of the stitching loop, just as in all sewing machines.

The said needle is also movable, in the two directions shown at 12, along a horizontal plane, transversely, for what will be the motion for the infeeding and moving forward of the materials to be stitched.

At 13 there is a first presser foot partially enshrouding the needle 10, that virtually extends parallel thereto and is given, similarly to the latter, horizontal translatory and transverse motion in the two directions shown at 11 and 12, respectively.

To the rear of the needle 10-first presser foot 13 ensemble is placed a second presser foot 14, movable horizontally solely in the two directions shown at 11 towards and away from an abutment surface integral with the overhanging head 5, the purpose of which is, as will also be seen below, to lock the materials stitched during the vamp ruffling operation. The said operation is carried out by a third ruffler presser foot 15, this too movable horizontally and transversely in the directions shown at 11 and 12 (but in the reverse direction to the transverse translatory motion of the needle), for locking and ruffling the vamp 1 jointly with a separator member 16 cantilever supported at the front part 5 of the machine through the medium of an arm 17, and extending to the front of the "crochet" containment assembly.

At 18, for folding the border of the shoe upper back over the vamp, there is a device that is virtually a disk, rotatable around a horizontal shaft (axis x—x) virtually perpendicular to the plane of the previously mentioned separator member 16.

The foregoing serves to present a general picture of the fundamental operating mechanism of the machine, and now an examination in greater detail will be made of the control devices for the individual pieces of mechanism, without directly naming the constructional items that belong to common mechanical techniques.

Figure 2:
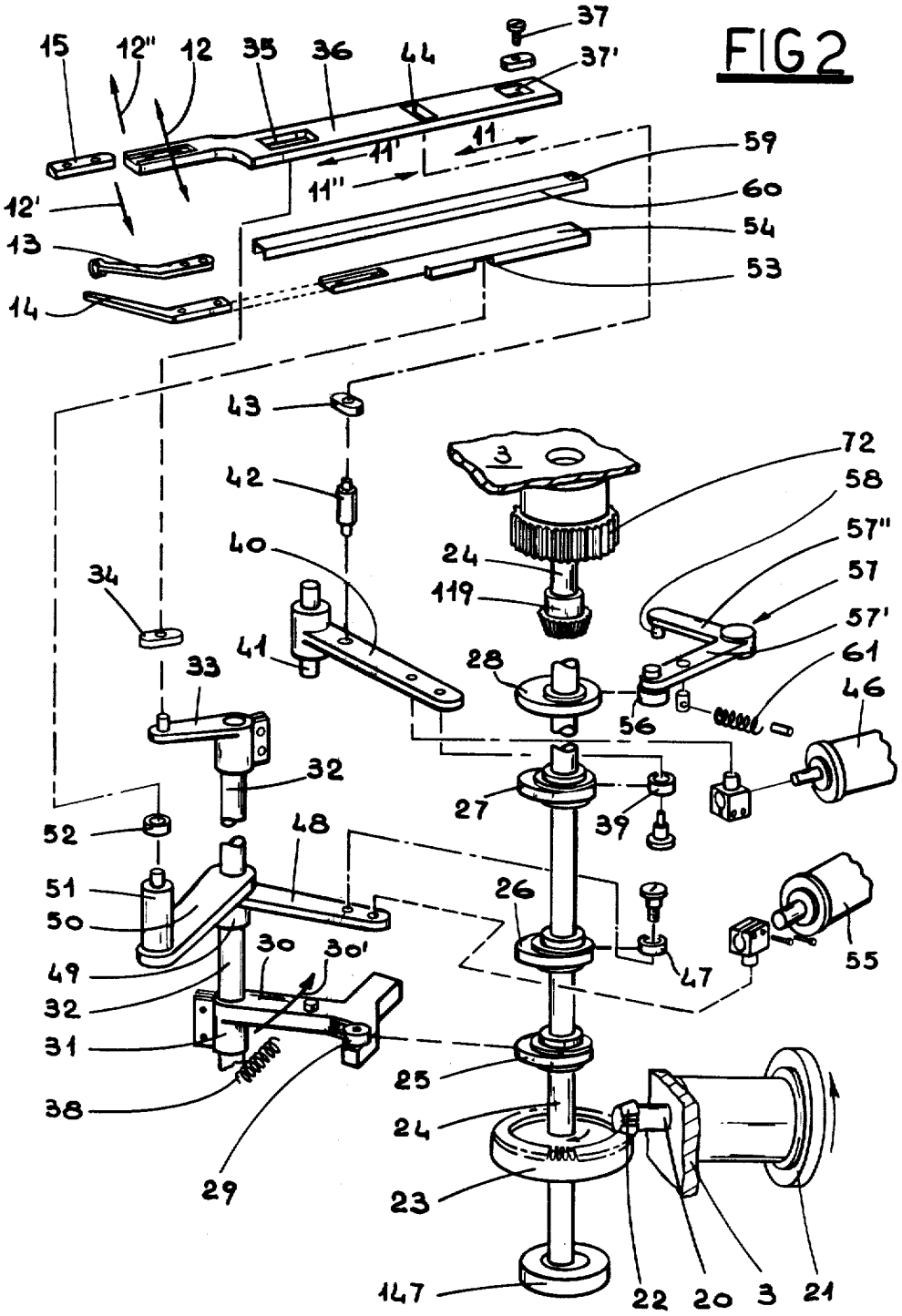
FIGS. 2, 3, 4 and 5 show, in exploded views with certain parts removed in order that others may be better stressed, the cam assembly that controls the various presser feet, the assembly that controls the translation of the needle and of the relevant presser foot, the assembly that controls and regulates the amount of material ruffled by the relevant presser foot and, lastly, the assembly that controls the fold-back device.

With reference to FIG. 2, motion is given to the primary horizontal shaft 20 on which is keyed a flywheel 21 which, via a pair of bevel gears 22 and 23, controls the rotation of a first vertical shaft 24 on which are rigidly mounted four cams 25, 26, 27 and 28, hereinafter referred to as the camshaft.

The first cam 25, through a roller 29, controls the reciprocating two-way oscillation of an arm 30 provided, at one extremity thereof, with a sleeve 31 fastened tightly to a vertical shaft 32 that extends inside the frame of the machine and is provided at the top with a lever 33 that couples, through a pawl 34 and a longitudinal slot 35, with the support member 36 of the said third ruffler presser foot 15. At the rear, the said support member is pivoted at 37 to the base frame through a second longitudinal slot 37' that allows the presser foot 15 not only to perform the said movement 12 with transverse translation provided by the arm 30, which constitutes the vamp ruffling motion but also the movement shown at 11, virtually perpendicular to the previous movement, for causing the presser foot to approach and move away from the separator member 16. The rotation of the arm 30 in the counter clockwise direction 30' on the part of the cam 25, that causes a likewise counter clockwise rotation of the presser foot 15 in the direction of the arrow 12' and the said presser foot to approach the needle (with the ruffling of the vamp 1), is contrasted by a spring 38, one extremity of which is secured to the frame 3 of the machine.

The horizontal translatory motion of the ruffler presser foot in the direction of the arrow 11 is given to it through the third cam 27 on which presses, via a roller 39, an arm 40, pivoted at 41 to the frame 3 and provided with a pin 42 that couples, by means of a pawl 43, with a transverse slot 44 also machined in the support 36 of the ruffler presser foot which, similarly to the other slots 35 and 37', allows the aforementioned compound movements in two perpendicular directions of the support 36 to take place.

Shaped at the extremity virtually in the form of an "L" that extends in a horizontal plane, the ruffler presser foot 15 has, in the region of the free limb, a projection 45 extending vertically and serving, as will be seen, as an abutment surface for the shoe upper folded back in unison with the device 18.

The arm 40 also has pivoted to it the rod of a first pneumatic piston 46 whose body is integral with the frame 3, and the operation of which determines a counter clockwise rotation of the arm 40 and thus a translation of the ruffler presser foot in the direction of the arrow 11'' with the displacement of the latter away from the separator member 16, into a non-operative position outside the action field of the cam 27.

The second cam 26 operates, via a roller 47, on an arm 48 integral with a sleeve 49 with which is also integral a further arm 50 provided with a vertical pin 51 which, via a roller 52 and slot 53, moves the support 54 of the second presser foot 14. The sleeve 49 turns loosely around the shaft 32, while to the arm 48 is also pivotally connected the rod of a second pneumatic piston 55 whose body is integral with the frame 3, and the operation of which determines a counter clockwise rotation of the arms 48 and 50 as well as a translation of the locking presser foot 14 in the direction of the arrow 11'' with a displacement of the latter away from the fixed containment body of the "crochet" that constitutes the abutment surface for the said second presser foot. The support 54 of the second presser foot slides along corresponding guides machined directly in the limb 4 of the base frame of the machine.

Again with reference to FIG. 2, on the profile of the fourth cam 28 presses a roller 56 pivoted to a lever 57' of an "L" shaped arm 57, pivoted vertically to the frame 3, whose lever 57'' is provided with a pin 58 that can be inserted into a slot 59 made in the rear of a support 60 for the first presser foot 13. Contact between the cam 28 and the roller 56 is maintained by an elastic spring 61 integral, at one extremity, with the frame 3. The rotation of the said arm 57 clockwise and counter clockwise, respectively, determines, therefore, a translation of the first presser foot in the direction shown at 11'' and 11', respectively, that is to say, the displacement away from and towards the fixed containment body of the "crochet" of the said first presser foot.

Figure 5:
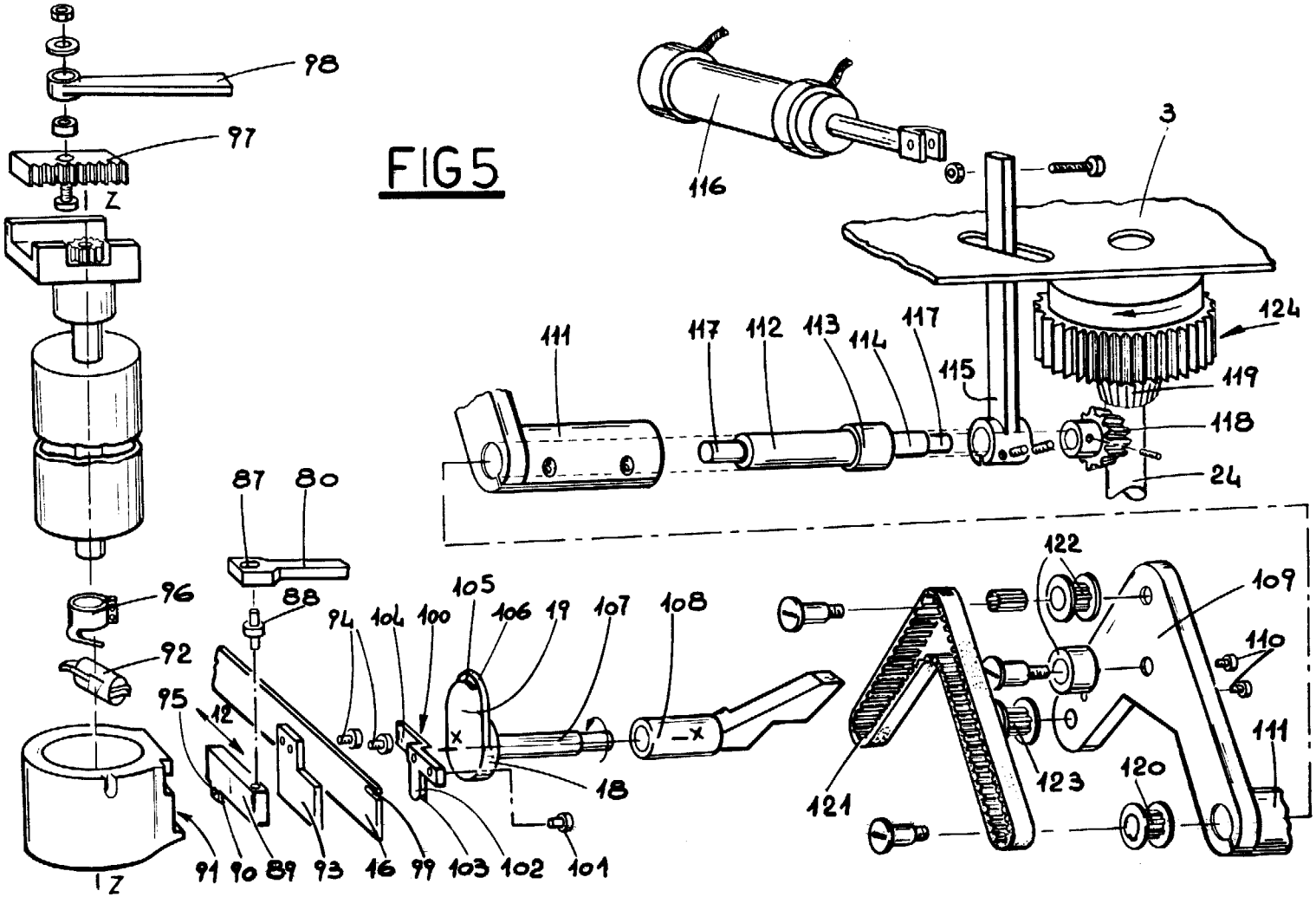

With reference to FIG. 5, the support 60 of the first presser foot slides as indicated at 11, inside a corresponding longitudinal guide 64 machined along the lower part of a horizontal support member 62, pivoted at the rear extremity, at 63, to the frame 3 and provided, moreover, with a further horizontal guide 65, parallel to the guide 64, inside which slides a cylindrical rod 66, to the front extremity of which is fixed the needle 10.

Thanks to the support member 62 it is, therefore, possible to achieve a separate translation, in the two directions of the arrow 11, both of the needle 10 and of the first presser foot 13, with the contemporaneous translation of both, as indicated at 12.

The reciprocating movement of the rod 66 is controlled by a crank 67 pivoted, at one extremity 68, to a pin 69 integral with the said rod 66 and, at the other extremity 70, to the lower surface of a first vertical axis spur gear 71 meshing with a second gear 72 keyed to the upper extremity of the camshaft 24.

The translation (so called though in actual practice a rotation around the pivot 63) of the support member 62, as indicated by the arrow 12, is achieved through a fifth cam 73, rigidly mounted on a vertical shaft 74 moved by the spur gear 71, onto the profile of which presses, via a roller 75, a lever 76 pivotally connected at the front to a vertical pin 77 of an "L" shaped member 81, the horizontal limb 82 of which is, in turn, pivoted, through a pawl 78 and slot 79, to a lever 80 fixed, in a projecting fashion, to the front extremity of the support member 62. The lever 76 is pivotally connected at the rear to a movable fulcrum 83 (the variation in position of which through a knob 84 and a bifurcated member 85 determines the regulation of the length of the stitch) and it is kept in contact with the relevant cam 73 through a spring 86.

The front projecting extremity of the lever 80 (see also FIGS. 5, 6 and 11) is provided with a longitudinal slot 87 inside which fits a pin 88 vertically integral with a plate 89 that extends in a plane perpendicular to the needle 10, has at the lower part thereof a dog 90 and can slide horizontally and transversely, in the two directions of the arrow 12, inside a guide 91 machined in the containment body 6 of the "crochet" 92. The containment of the plate 89 in the body 6 is achieved through a second plate 93 fastened to the said body by means of screws 94, while the dog 90 has in it a hole 95 for the passage of the needle 10 and the formation of the stitch.

Figure 3:
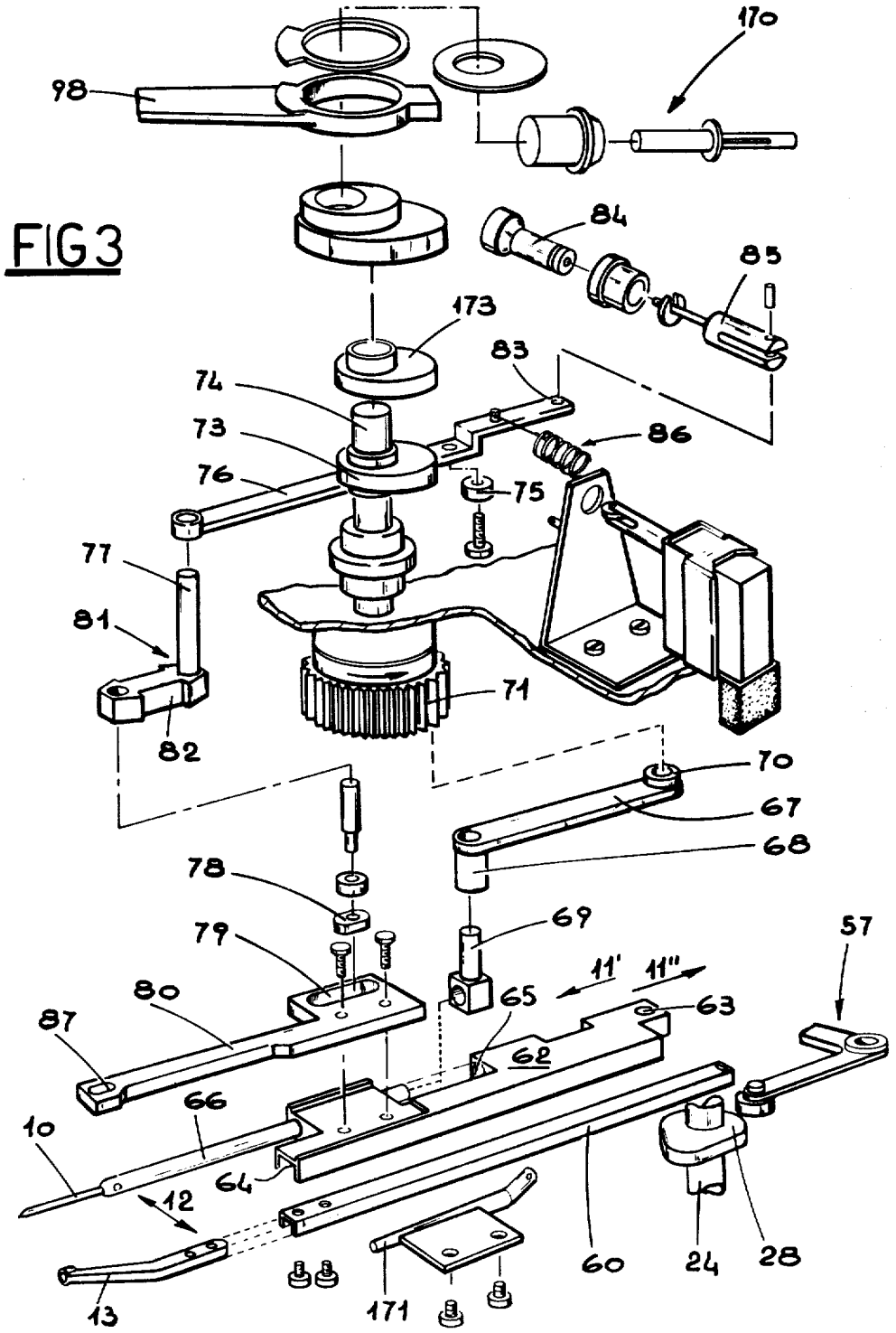

The body 6 is integral with the overhanging head 5 of the machine and it contains the "crochet" 92, connected to the "crochet" holder 96, which is carried in rotation alternately in the two directions around the vertical axis (z—z) in a known fashion, through a rack 97 controlled by a link rod 98 pivoted eccentrically to the vertical shaft 74 (see FIG. 3).

In this way, with the concatenation between the lever 80 and the dog 90, the transverse movement as indicated by the arrow 12, occurs of the three elements composed of the needle 10, the first presser foot 13 and the dog 90.

Again with reference to FIGS. 5 and 6, the separator member 16, made in the form of a thin gage blade of elastically flexible material, extends in a vertical plane, is positioned in the vicinity of the plate 93, to the front thereof, and has a groove 99 that open externally in order to permit the passage of the needle 10 and its transverse translation, when the needle is in the lowered position, as indicated by the arrow 12.

At 100 there is a member that can also be secured to the body 6 through screws 101 and has, vertically, a bar 102 that extends, at the lower free extremity thereof, above the separator member 16, and is provided with a bevel 103 that cooperates therewith in order to fold the shoe upper back over the vamp and to maintain the said fold. The said member 100 also has a plate 104 for the protection of the operative.

The final piece of operating mechanism on the machine is constituted by the fold-back device 18 which, as can be seen in FIG. 6, consists of a disk provided with a protruding portion 19 rotatable around the horizontal axis (x—x) clockwise when looking at FIG. 6, the said protruding portion being provided with a slot 105 that defines a tail piece 106 whose function is to allow the passage of the needle 10 and the contemporaneous action of pressure on the shoe upper on the part of the device 18. Integral with the device 18 is a rod 107, rotatable inside a sleeve 108 cantilever supported by an "L" shaped plate 109 with the aid of screws 110, the said plate 109 being provided, at one extremity, with a sleeve 111 constrained to the rotation of a pin 112 integral with a hollow shaft 113 pivoted to the frame of the machine (see FIG. 11) and provided, at the opposite extremity, with a second pin 114 to which is fixed a lever 115 subjected to the action of a third pneumatic piston 116.

Inside the hollow shaft 113 is placed a shaft 117 onto the opposite extremities of which are keyed a bevel gear 118 (that meshes with a corresponding bevel gear 119 rigidly mounted on the camshaft 24, see FIG. 2) and a sprocket 120, respectively, the latter transmitting the motion of rotation to the fold-back device 18 via a belt 121, the transmission rollers 122 and a roller 123 keyed to the extremity of the rod 107.

With the above described form of embodiment, it is thus possible to achieve, in this way, the contemporaneous continuous rotation of the fold-back device 18 and the removal or approach of this (that is to say, the positioning at the commencement of the operation) away from or towards the separator member, through the operation of the piston 116, the actuation of which determines a rotation of the lever 115 in the direction of the arrow 124 and, with this, a small rotation in the same direction of the "L" shaped plate 109 and of the complete fold-back device 18.

Figure 4:
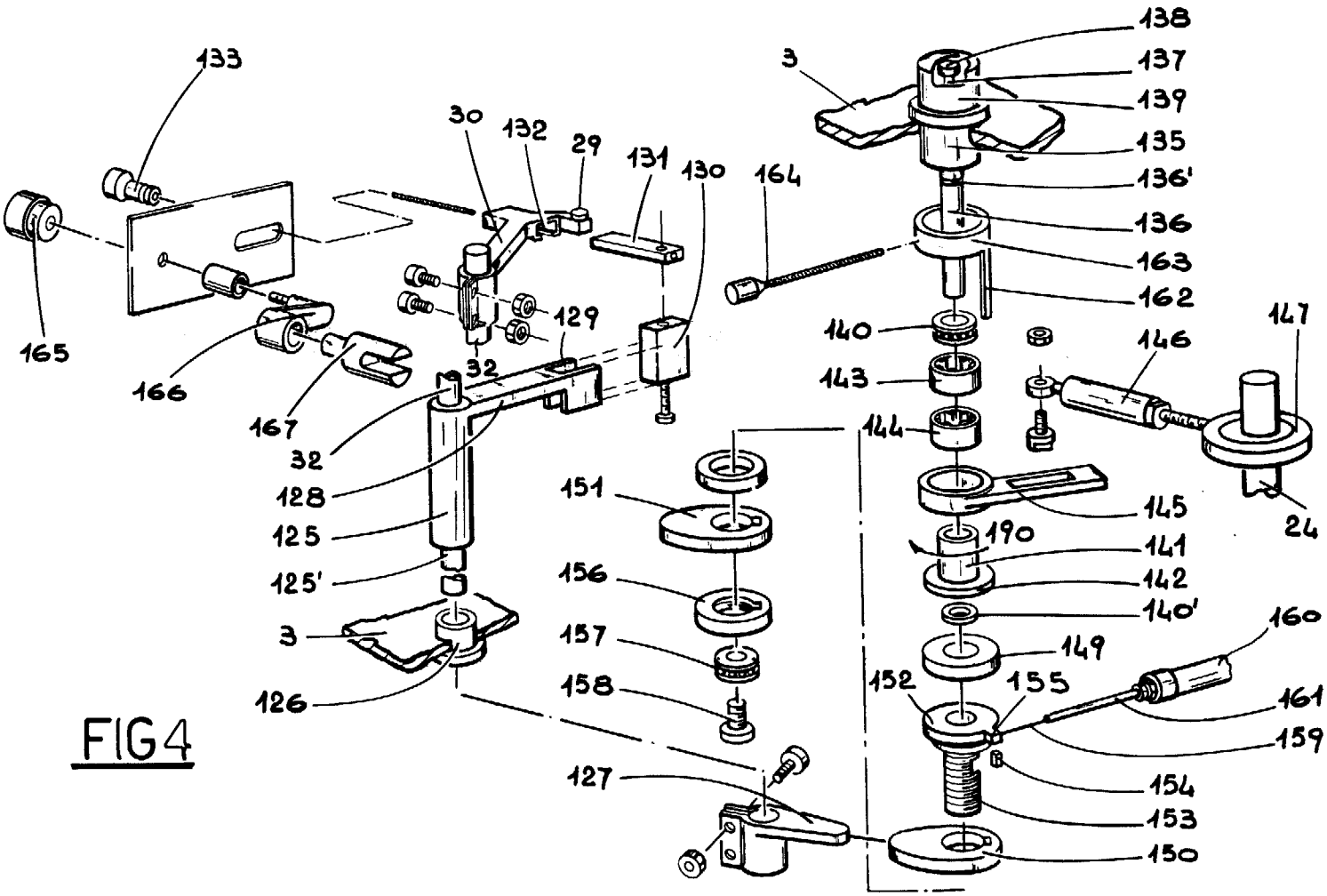

Reference will now be made to FIG. 4 in which is illustrated the complex of parts that permit the amount of ruffle to be regulated as a function of the stitching position, namely whether as stated earlier on, the stitching is at the commencement or in the center.

The arm 30, which is the one moved by the first cam 25, is integral with the shaft 32 whose lower part idles inside a hollow body 125 loosely supported, vertically, by the base frame 3 of the machine, by means of a support 126, the bottom part of which terminates in a pin 125' to which is secured an abutment lever 127.

The hollow body 125 is provided with a horizontal arm 128 having a vertical seat 129 inside which fits a block 130 to which is pivoted, at the top, a lever 131 that slides inside the groove 132 machined in the extremity of the arm 30.

Through a knob 133 connected to the arm 30 it is possible to adjust the position of the lever 131 and, therefore, to determine a greater or lesser reciprocal approach or removal, both of the arm 30 and of the hollow body 125, that is to say, to the stationary position of the arm 30 corresponds, through a rotation of the knob 133, a movement away from or an approach thereto of the hollow body 125 and, in consequence, a different position of the lever 127 with respect to the cams 150 and 151, as will be seen below, the foregoing determining a greater or lesser amount of ruffle of the vamp that is not dependent on the stitching position.

In the righthand side of FIG. 4, shown at 135, there is an internally hollow support, integral with the frame of the machine, provided with a rod 136 that extends vertically downwards, inside which slides the rod 137 of a penumatic piston 138 whose body 139 is integral with the support 135. Externally to the rod 136 is inserted a sleeve 141 provided, at the lower part, with a flange 142, externally to which there is a first thrust bearing 140 and a pair of pawl type inner ring bearings 143 and 144, the former having the external ring forced over the inside cylindrical surface of the liner of the support 135, and the latter, the external ring forced into the eye of a rocker arm 145, the oscillation of which is controlled by a crank 146 provided with a sleeve 147 pivoted eccentrically to the lower extremity of the camshaft 24 (see also FIG. 2).

The sleeve 141 is then locked axially to the rod 136 by means of an elastic ring 140' that can be inserted in a corresponding groove 136'.

In this way, thanks to the employment of the two pawl type inner ring bearings 143 and 144, which are mounted one opposite the other, it is possible to transform a bidirectional oscillation of the rocker arm 145 into an intermittent rotation, in one single direction (clockwise as shown with the arrow 190), of the sleeve 141 (this being taken care of by the inner ring bearing 144), while the other inner ring bearing 143 serves as an element for locking the sleeve 141 in the counter clockwise return direction.

To the flange 142 of the sleeve 141 is bonded a clutch member 149.

At 152 is shown the flange of a second internally hollow sleeve 153, on the outside of which are fitted, with the aid of a spline 154, two cams 150 and 151 that are locked axially through a threaded washer 156. The said second sleeve is inserted over the outside of the rod 136 of the support 135 and is free to be able to rotate there around and to translate longitudinally along the axis thereof under the action of the pneumatic piston 138, the rod 137 of which is fastened, low down, to an axial bearing 157 through a screw 158.

The operation of the pneumatic piston 138 thus determines an upward translation, though minimum, of the cams 150 and 151, and with them, of the second sleeve 153, the flange 152 of which abuts with the clutch member 149, thereby matching the rotation of the cams with the intermittent clockwise rotation of the sleeve 141. The non-operation of the piston 138, which determines the separation of the flange 152 from the above mentioned clutch, gives rise to a counter clockwise rotation of the cams 150 and 151 under the action of a return system composed of a pneumatic piston 160, acting as a spring, the rod 161 of which is integral with a wire 159 wound around and fixed to the sleeve 153, until the time when a tooth 155 on the flange 152 comes flush up against a stop 162 machined vertically in a cylindrical body 163 inserted externally over the support 135, the position of which can be adjusted by rotating a knob 164.

The abutment of the lever 127 onto the first cam 150 or the second cam 151 (for stitching shoes for the right foot and for the left foot, respectively) is selected by rotating, between two preset positions, a knob 165 to which is keyed a crank 166 provided, at the free extremity, with a fork 167 that externally surrounds the arm 128. The said crank determines a vertical axial sliding motion on the part of the hollow body 125 in the inside of the relevant support 126, this being possible because of the coupling between the vertical seat 129 and the block 130, with respect to the translation between the two bodies 30 and 125.

Finally, with reference again to FIG. 3, at 170, shown globally, is the complex of parts for the support of the reel, and at 171 a thread guide that extends up to the vicinity of the needle 10 and is fixed to the lower part of the support member 62 which also serves as the element for the containment of the support 60 in the inside of the member 62.

A brief description will now be given of the operation of the machine in question.

First of all, through the knob 84, the length of the stitch is selected by varying the position of the fulcrum 83 of the lever 76 which thus brings about, compatibly with the profile of the cam 75, a greater or lesser stroke on the part of the needle 10-first presser foot 13-dog 90 ensemble. Then, using the knob 165, the lever 127 is positioned on the first cam 150 or on the second cam 151, depending on the type of shoe (right foot or left foot) and afterwards, through the knob 164, the initial position is determined of the above mentioned cams for varying the commencing amount of ruffle.

At this juncture, the machine is ready to operate and it is necessary to insert beneath the operating mechanism, the parts to be stitched and to do this, use is made of, for example, a pedal for actuating the pneumatic pistons 55, 46 and 116 which control the raising of the second presser foot 14 and the removal of it from the body 6, the raising of the third ruffler presser foot from the separator member and the raising of the fold-back device 18, while the piston 138 is operated to bring about the coupling between the flanges 142 and 152. As can be seen in FIG. 6, the vamp 1 is inserted, at this stage, between the ruffler presser foot 15 and the separator blade 16, while the shoe upper 2 on the other side of the blade is folded back over itself and is folded back over the vamp and over the vertical projection 45 of the presser foot 15.

In the configuration corresponding to FIG. 6, the following occurs:

- the ruffler presser foot 15 is lowered against the blade 16 locking the vamp;
- the fold-back device 18 is in position and actively folding the shoe upper back over the presser foot 15:
- the second presser foot 14 is lowered locking the vamp and shoe upper;
- the first presser foot 13 is raised similarly to the needle 10 in order to allow the passage of the fold-back device 18.

Continuing with the stitching, the configuration shown in FIG. 7 is reached, wherein:

- the fold-back device 18 is about to terminate its operation and has "uncovered" with the slot 105, the hole 95 in the dog 90 for the passage of the needle;
- the ruffler presser foot 15 has come to the end of its active stroke 12' (high point of the cam 25) and has arrived in the vicinity of the needle which, together with its own presser foot and the dog 90, is in the maximum forward transverse position, that is to say, at the maximum stroke 12";
- the needle is starting to penetrate into the parts to be stitched;
- the second locking presser foot is still lowered holding firm the vamp-shoe upper ensemble.

Figure 8:
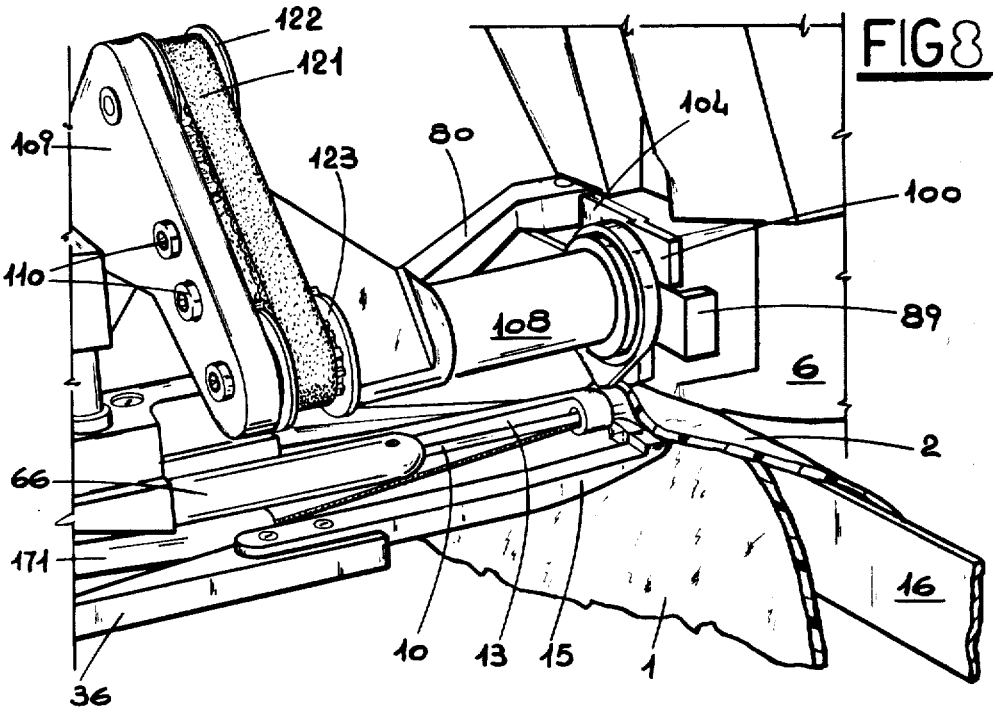

Proceeding further, as per FIG. 8:

- the needle 10 has already locked the vamp-shoe upper ensemble;
- the second presser foot 14 is raised;
- the fold-back device 18 has just completed its operation with also the tail piece 106 which has just left the shoe upper;
- the first presser foot 13 has lowered to lock the shoe upper folded back over the vamp;
- the needle 10-first presser foot 13-dog 90 ensemble starts to carry, in the direction of the arrow 12', the vamp and shoe upper material for the formation of the stitch;
- the ruffler presser foot 15 has risen (moved by the cam 27) and is commencing its return travel in the direction of the arrow 12".

Figure 9:
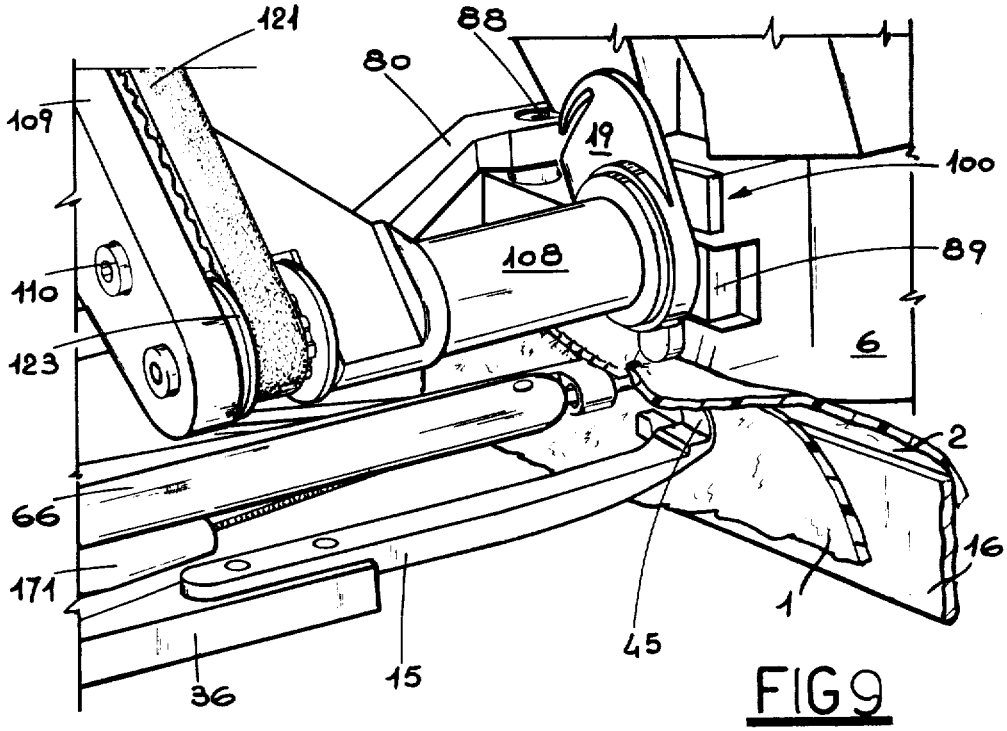

FIG. 9 is now reached, where:

- the penetration of the needle 10 is complete for the formation of the stitch;
- the needle 10-first presser foot 13-dog 90 ensemble is at the end of the carrying stroke, that is to say, it has caused the vamp and the shoe upper to move forward by one stitch;
- the second presser foot 14 is lowered locking the stitch;
- the ruffler presser foot 15 is raised and in the process of terminating the passive return stroke.

Figure 10:
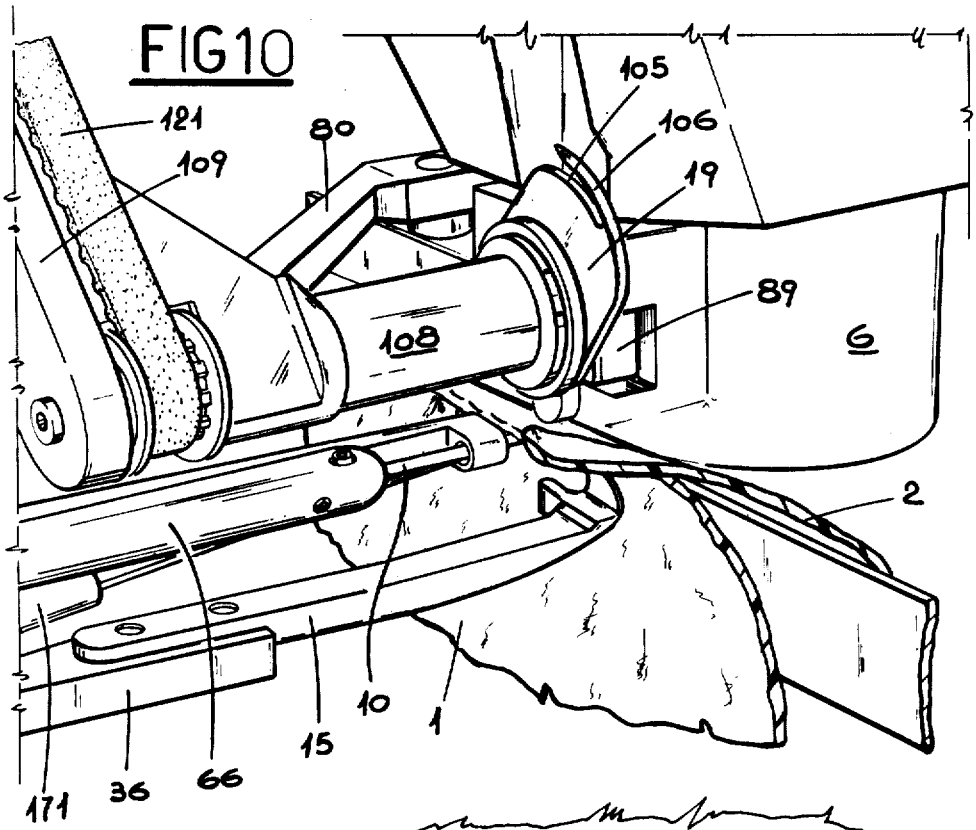

Finally, FIG. 10 is reached, where:

- the first presser foot 13 is raised;
- the needle 10 is returning backwards;
- the ruffler presser foot is at the maximum backward passive stroke (abutment of the lever 127 against the cam 150);
- the fold-back device is about to commence a fresh working stroke in order to repeat the cycle described above.

Figure 13:
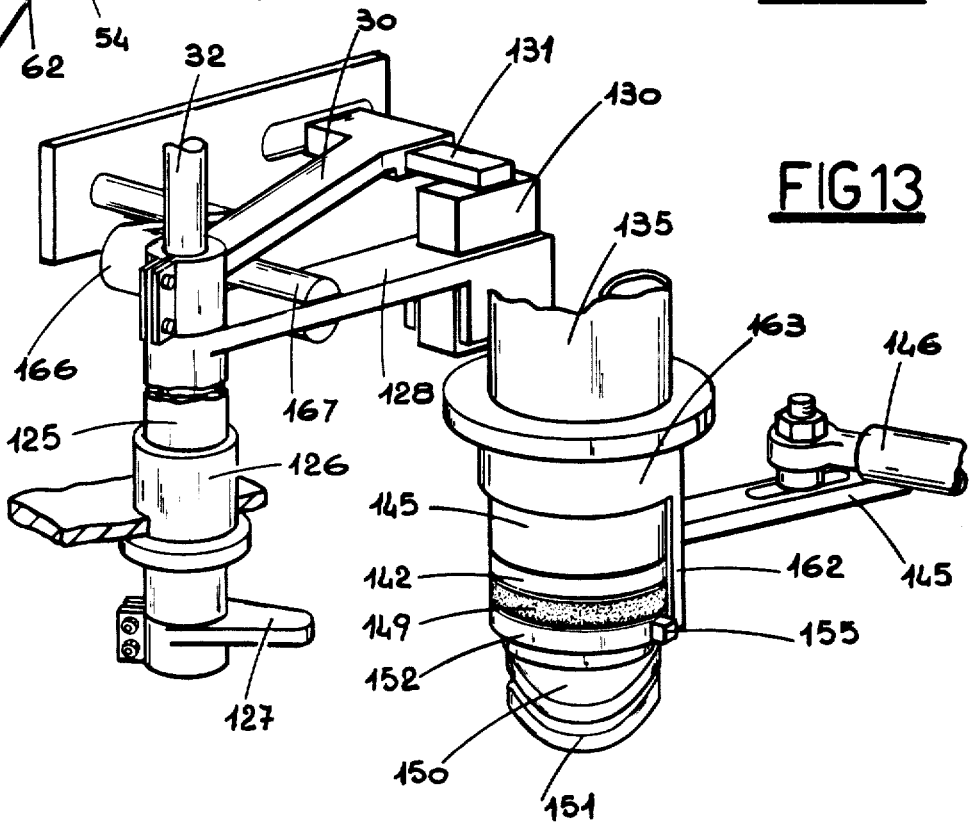
FIG. 13 shows, diagrammatically, a perspective view of the operating means that contribute to the transverse translation of the third ruffler presser foot.

It is important to note that (see also FIG. 13) the end of the return stroke of the ruffler presser foot 15 corresponds to the abutment of the lever 127 against the cam 150 which is not immobile but, carried in rotation by the rocker arm 145 as seen earlier on, constitutes an abutment member variable each time to suit the ruffling moment, which is minimum at the commencement and maximum midway in the region of the toe of the shoe, and then decreases again at the end of the stitching operation, upon completion of which (after a certain turn of the cam 150) the pneumatic piston 138 that controls the parting of the sleeve 153 from the clutch 149 is set in operation, after which the cam 150 is returned to the initial cycle position by the piston 160 which acts as a return spring through the abutment of the tooth 155 on the stop 162.

This is because it is possible in this way to vary the amount of the ruffle (knob 164) to suit the number of stitches needed (that is to say, when changing over from one type of shoe to another) without having to touch the component parts of the machine, also for going from cam 150 to cam 151 for the changeover from shoes for the right foot to those for the left foot.

As has been seen, when not operating, the pneumatic pistons utilized act as elastic elements, while the fold-back device 18 has been so shaped, that is to say, with the presence of the tail piece 106, in order to allow a contemporaneous action of the needle 10 with the contemporaneous maintaining of the fold of the shoe upper, above all for particularly rigid hides that tend not to keep the fold given initially, though with softer hides the protruding portion 19 can be reduced to a simple tongue of limited width.

The fold-back device 18 will obviously complete one turn per cycle of the needle 10, while to maintaining the folding of the shoe upper also contributes the bar 102, in the bevel 103 (see FIG. 10) of which is contained the shoe upper folded back over the vamp.

It has been seen that with the machine in question not only is it possible to achieve the traditional type protruding "ridge" of stitching, through the particular use of the fold-back device but also to continuously and automatically vary the amount of ruffle during the stitching operation.

In its practical form of embodiment, the invention may also adopt forms differing from what has been described above, and numerous modifications of a practical nature may, in particular, be made without in any way deviating from the framework of protection afforded to the invention.

What is claimed is:

1. A machine for stitching the upper border of shoes, such as moccasins, said machine comprising: a base body extending essentially vertically, and being essentially in the form of an inverted "U", and having a front with an overhanging head containing a vertical shaft mounted crochet, said machine being provided with a needle movable horizontally, with reciprocating motion, in two directions towards and away from said crochet, and being given, in time with the latter, transverse translatory motion in a horizontal plane, perpendicular to its own axis, for infeeding of material, said machine being equipped with a dog supported by said overhanging head in front of said crochet, movable horizontally along a vertical plane, virtually perpendicular to said needle and in harmony with the horizontal transverse translatory motion thereof, said dog constituting a movable working surface for the abutment of the edges of a vamp and of a shoe upper to be stitched, and comprising a first presser foot, cantilever-supported horizontally by said body in the immediate vicinity of said needle, and also movable similarly to the latter, horizontally and transversely, to operate in contrast with said dog and to lock the material-shoe uppervamp ensemble and to displace it in time with the horizontal transverse movement of the needle, said machine also comprising a second presser foot, cantilever-supported horizontally by said body to the rear of said first presser foot with respect to the transverse infeed direction of the material, movable horizontally in the two directions and in contrast with said overhanging head in order to lock the material already stitched and carried along by the needle-first presser foot-dog ensemble, said machine further comprising: a virtually flat separator member that extends in a vertical plane parallel to that of said dog, positioned upstream of said needle and designed to separate the vamp from the shoe upper being fed to the needle; a third ruffler presser foot, cantilever-supported horizontally by said body, placed upstream of the first presser foot and movable horizontally in two directions towards and away from said separator member, in contrast therewith, subjected to means for transverse translation in the two directions, along a path parallel to said dog but in the direction opposite to that of the translation of the latter, said third presser foot being provided to lock and ruffle the vamp jointly with said separator member; and a fold-back device cantilever-supported by said body, located above said third presser foot, provided to fold, at the point where said third presser foot is lowered to lock the vamp on the separator, the border of the shoe upper back onto the vamp.

2. A machine according to claim 1, wherein said separator member is constituted by a thin gage blade made of elastic material, placed in a vertical plane parallel to that of said dog and in front of said dog with respect to said needle.

3. A machine according to claim 2, wherein said blade is provided with a groove that extends horizontally in the transverse displacement direction of the needle, for the passage thereof.

4. A machine according to claim 1, wherein said fold-back device comprises a disk provided with a protruding portion, rotatable around a horizontal axis virtually perpendicular to the plane of said separator member, lying in a vertical plane placed to the front of the latter, in time with the movement of the needle and operating, with said protruding portion, on the border of the shoe upper at the time the ruffling commences on the part of said third presser foot.

5. A machine according to claim 1, wherein said third ruffler presser foot, shaped at the extremity in an "L" that extends in a horizontal plane, has, in the region of its free limb, a projection extending in a vertical plane placed between the plane of said fold-back device and the plane of said separator member, when said third presser foot is in the lowered position in contrast with the latter mentioned member.

6. A machine according to claim 4, wherein said disk rotates clockwise, when looking from the side of the needle, and wherein said protruding portion has an open elongated slot that extends in a curve for the passage of the needle and defines a tail piece with the vertex pointing from the opposite side with respect to the aforementioned direction of rotation.

7. A machine according to claim 1, comprising an abutment member fixed to said base body of said machine and extending, at the lower free extremity, above the separator member, in a vertical plane to the rear of the plane of rotation of said fold-back device.

8. A machine according to claim 7, wherein said abutment member is provided in its lower part with a bevel that is concave and extends along a plane parallel to that of the blade, for the containment of the shoe upper folded by said fold-back device.

9. A machine according to claim 1, comprising means of actuation for said fold-back device, provided to move it away from the operating position close to the blade.

10. A machine according to claim 9, wherein said disk is integral with a rod rotatable inside a sleeve cantilever-supported by an L-shaped plate, the latter being integral for rotation with a hollow shaft pivoted to the frame of the machine and provided at the opposite extremity to said plate, with a lever integral therewith, subjected to the action of said actuating means.

11. A machine according to claim 10, wherein said hollow shaft is provided, rotatable internally, with a shaft carried in continuous rotation by the operating mechanism of the machine and having, in the region of said "L" shaped plate, a roller on which is mounted a belt sealed around a second roller keyed to the extremity of said rod.

12. A machine according to claim 1, comprising a horizontal support member, carried by said base body in the region of the rear extremity thereof, a lower part of which is provided with a longitudinal guide for the containment and sliding movement of a support for said first presser foot, and provided, furthermore, with an additional horizontal guide, parallel to the one previously mentioned, for the containment and sliding movement of a rod to whose front extremity is fixed said needle, said support member being subjected to means for controlling said transverse translation of said needle and of said first presser foot, said support member being provided at the front with a projecting lever pivoted to the front of said dog.

13. A machine according to claim 1, wherein said means for the transverse translation of said third presser foot comprises an arm placed in contact with the profile of a cam carried in rotation by the movement mechanism of the machine, and pivoted to a support member of said presser foot for the transverse translation thereof in one direction, abutment means being provided for blocking the transverse translation of said presser foot in the opposite direction, said abutment means being variable in position during stitching.

14. A machine according to claim 13, wherein said arm is fastened to a vertical shaft provided, at the top, with a lever that couples with said support member, and wherein said abutment means are constituted by a lever fixed, in an overhanging fashion, to said shaft and at least one cam, carried in rotation by the drive mechanism of the machine, constituting the abutment surface for said lever, designed to permit an ever greater rotation of said arm and, therefore, a greater transverse translation of said presser foot at the point where the changeover occurs from the initial stitching to the central stitching and vice versa.

15. A machine according to claim 14, wherein said cam is keyed to a first sleeve carried in rotation, in one single direction, through a pawl-type inner ring bearing system, a rocker arm whose reciprocating oscillation is controlled by a crank pivoted eccentrically to a shaft connected to the movement mechanism of the machine.

16. A machine according to claim 15, wherein said rocker arm is connected, via said pawl-type inner ring bearing system to a second sleeve, means being provided for connecting said first sleeve for rotation of said second sleeve, and means for returning said cam to the cycle commencement non-operative position when disunion occurs between said pair of sleeves.

17. A machine according to claim 16, wherein said connecting means are constituted by a cylinder operating on one of said sleeves, provided for the mutual axial translation of said sleeves, and by a clutch member interposed therebetween.

18. A machine according to claim 16, wherein said return means are constituted by a pneumatic piston having a rod integral with a wire wound around and fixed to said first sleeve, the latter being provided with a tooth provided to abut, at the time said return takes place, with a stop integral with said base body.

19. A machine according to claim 18, wherein said stop is machined in a cylindrical body supported by the frame and adjustable in position.

20. A machine according to claim 13, comprising at least two cams, integral with said first sleeve, and means for positioning said lever laterally with respect to one or the other of said cams.

* * * * *